US005716037A

United States Patent [19]

Haak

[11] Patent Number: 5,716,037

[45] Date of Patent: Feb. 10, 1998

[54] SEISMIC ISOLATOR

[76] Inventor: Wayne R. Haak, 960 10th St., No. 6, Santa Monica, Calif. 90403

[21] Appl. No.: 518,152

[22] Filed: Aug. 23, 1995

[51] Int. Cl.[6] ..... F16M 13/00; E04B 1/36; E04H 9/06

[52] U.S. Cl. ..... 248/562; 248/636; 248/638; 248/913; 52/167 R; 52/167 DF

[58] Field of Search ..... 248/638, 613, 248/581, 570, 585, 562, 913; 367/190; 101/110, 288, 348; 198/626.5; 192/207; 384/618; 414/790.9

[56] References Cited

U.S. PATENT DOCUMENTS

| | | | |
|---|---|---|---|
| 3,155,387 | 11/1964 | Buccicone | 198/780 |
| 4,093,054 | 6/1978 | Johns | 192/106.1 |
| 4,371,143 | 2/1983 | Ishida et al. | 248/638 |
| 4,402,483 | 9/1983 | Kurabayashi et al. | 248/636 |
| 4,496,130 | 1/1985 | Toyama | 248/585 |
| 4,565,039 | 1/1986 | Oguro et al. | 52/167 |
| 4,577,826 | 3/1986 | Bergstrom et al. | 248/636 |
| 4,596,373 | 6/1986 | Omi et al. | 248/562 |
| 4,617,769 | 10/1986 | Fyfe et al. | 52/167 |
| 4,662,133 | 5/1987 | Kondo | 52/167 |
| 4,726,161 | 2/1988 | Yaghoubian | 52/167 |
| 4,801,122 | 1/1989 | Stahl | 248/636 |
| 4,906,113 | 3/1990 | Sague | 384/618 |
| 4,917,211 | 4/1990 | Yamada | 181/5 |
| 4,941,640 | 7/1990 | Nakamura | 248/562 |
| 5,035,394 | 7/1991 | Haak | 298/562 |

*Primary Examiner*—Ramon O. Ramirez
*Assistant Examiner*—Charles J. Hunter
*Attorney, Agent, or Firm*—Small Larkin & Kidde

[57] ABSTRACT

An isolator for protecting a display object from damage as a result of shock and vibration associated with seismic activity or other external forces. The isolator has a base support which is fixed in position with respect to the ground, an intermediate support which interengages with the base support and may slide side-to-side along one axis, a top support for mounting the object thereon and interengaging with the intermediate support to slide side-to-side along a different axis, and restoring means to urge the top and intermediate supports to return to their neutral rest positions. The interengagement between levels is accomplished by tracks that slidably engage rows of roller bearings rotatably mounted along opposite side edges of an adjacent support, and the restoring means include elongated, non-flexible compression spring assemblies formed by stacked Belleville washers that yieldably urge follower rollers against cam tracks formed along the sides of the supports. The cam tracks have central neutral depressions with wedge-shaped rises on opposite sides of the depressions. Alternative embodiments show a single spring and cam arrangement and a double roller bearing arrangement in which roller bearings are mounted at ninety degree angles to engage a cylindrical track bar.

33 Claims, 7 Drawing Sheets

A1
A2
12
14
A3
A4
42
32
40
36
34
64
B2
30
B1
60
46
58
86
56
84
62
68
74
66
76
82
80
63
16
B4
B3
48
C1
C2
C3
C4
18
52
50
38
44

SEISMIC ISOLATOR

BACKGROUND OF THE INVENTION

This invention generally relates to protection of objects from damage resulting from shock or vibration caused by external forces. More specifically, the invention relates to apparatus for protecting objects such as art objects and antiquities that are on display from damage resulting from seismic activity or other external jarring forces.

Statues, sculptures and other works of art or antiquities are often on display in museums, art galleries and residential or office buildings. Generally, such objects are very valuable and sometimes heavy, and thus, when displaying such objects, it is desirable to use measures that will prevent them from toppling over in case of earthquakes or other shock or vibration. A variety of configurations have been utilized in the past for protection of art objects from damage in earthquakes. In one approach, the object is designed to be exceedingly strong so that the object and its support, such as an entire building, move with the earth movement without damage. In another approach, the object is supported on some type of apparatus so that the object remains essentially fixed while the earth moves, with the object ultimately being restored to its original relationship with the earth. Structures of this nature are shown in U.S. Pat. Nos. 4,496,130, 4,596,373; and 4,801,122 and in Italian Patent No. 639,666. A variation utilizing cables and springs for controlling motion is also shown in U.S. Pat. Nos. 4,371,143; 4,402,483; 4,565,039; 4,577,826; 4,617,769; and 4,662,133.

Another variation is disclosed in U.S. Pat. No. 5,035,394, wherein an isolator utilizes a plurality of supports at different levels with interengaging means that provide for relative displacing movement between the levels along perpendicular axes so as to allow an object mounted on the top level of the isolator to be protected against damaging movement. As described in the latter patent, the interengaging means between each of the supports include bearings carried on one support that ride on tracks carried on the other support to provide the necessary load-carrying capability, and a relatively complex lever-actuated return system for restoring the supports to their normal positions after displacement has occurred.

While these prior designs have been adequate for protecting objects from damage resulting from earthquakes, some are relatively complex and expensive in construction and others are less than completely effective. The general objective of this invention is to provide a new and improved isolator that is simple in construction and relatively inexpensive, as well as strong, effective, durable and readily adaptable for use with objects of various sizes and weights.

SUMMARY OF THE INVENTION

Briefly and in general terms, the present invention provides an improved isolator of the general type disclosed in U.S. Pat. No. 5,035,394 that is substantially simpler and less expensive in construction and yet is highly effective for its intended purpose of protecting objects from seismic and other shocks and vibration. The present invention eliminates the need for relatively complex and expensive spring-loaded lever mechanisms for resisting displacement of the supports and restoring them to their original positions, and also provides a simpler and highly effective roller-and-track system for mounting the supports for relative movement. The result is a substantially improved seismic isolator that also is significantly different in construction and operation from the previously patented isolator.

More specifically, the isolator of the present invention utilizes parallel rows of rotatably mounted rollers on the respective supports, engaging parallel tracks on the adjacent sides of adjacent supports to provide highly effective and relatively simple mounting bearings between the adjacent supports, parallel to and defining the displacement axes, preferably with V-shaped grooves in the rollers closely engaging tracks of V-shaped cross-sectional shape for smooth and secure action. For smooth operation, the extreme end portion of each track is relieved to permit smooth disengagement and reengagement of the rollers at the ends of the tracks.

In addition, the isolator of the present invention utilizes a very rugged and dependable compression spring assembly for holding a cam follower, preferably with at least one roller forming each follower, in engagement with a cam track during displacement of adjacent supports, the preferred compression spring assembly comprising an elongated rod slidably secured to one support and projecting toward a cam track carried on the other support, with a compression spring telescoped over the rod and acting in compression between the associated support and the follower. The preferred spring is formed by a plurality of stacked spring washers of the Belleville type telescoped over the elongated rod between the follower and a guide which slidably mounts the rod (through a bronze-type bearing that itself is housed inside the guide) on the support. In this manner, the rod is retained in the guide, and is ready to slide relatively freely in response to a displacing force.

Each cam follower preferably comprises a pair of side-by-side, spaced roller bearings that are rotatably mounted on a housing secured to one end of the rod adjacent the compression spring that is telescoped over the rod. By spacing the roller bearings apart, the compression spring assembly is made less prone to torsional movement about the longitudinal axis of the rod.

Other aspects and advantages of the invention will become more apparent from the following detailed description thereof, taken in conjunction with the accompanying exemplary drawings.

DETAILED DESCRIPTION OF THE PREFERRED EMBODIMENTS

Figure 1:
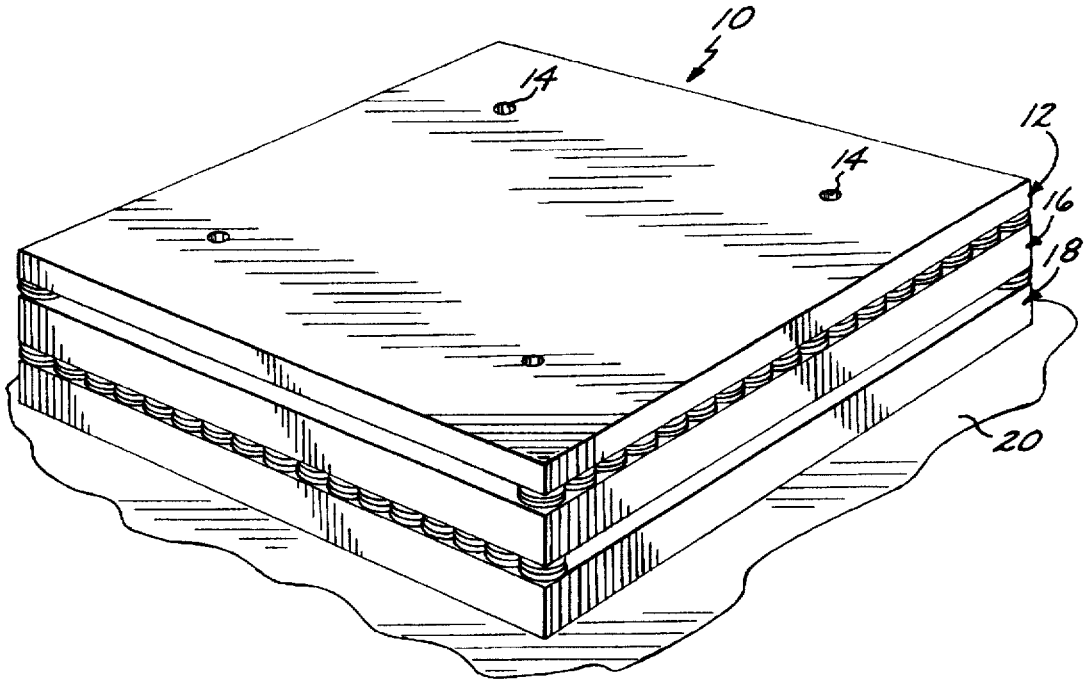
FIG. 1 is a schematic perspective view of an isolator embodying the present invention.

As shown in the drawings for purposes of illustration, the invention is incorporated in an isolator, indicated generally by the reference number 10, for mounting a display object such as a statue, sculpture or work of art, indicated generally by the reference number 11 (see FIG. 1A) thereon, and protecting the object from damage due to severe external forces causing vibration or shock such as in an earthquake. In such an event, the invention is adapted to absorb the shock or vibration by moving horizontally from its normally centered rest or neutral position in a non-violent manner until the shock or vibration ceases to exist and the object returns to its centered rest position.

Figure 2:
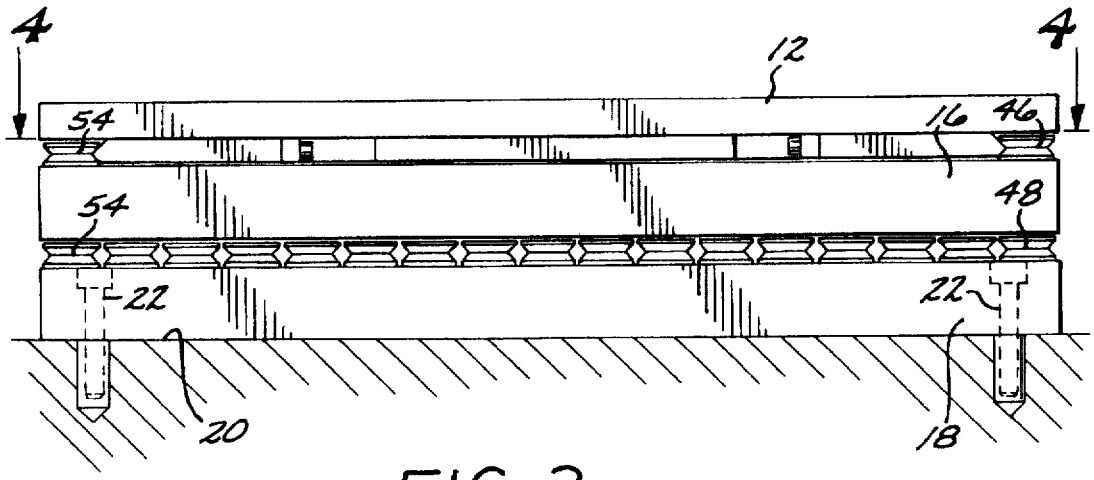
FIG. 2 is a side elevational view of the isolator shown in FIG. 1.
Figure 1A:
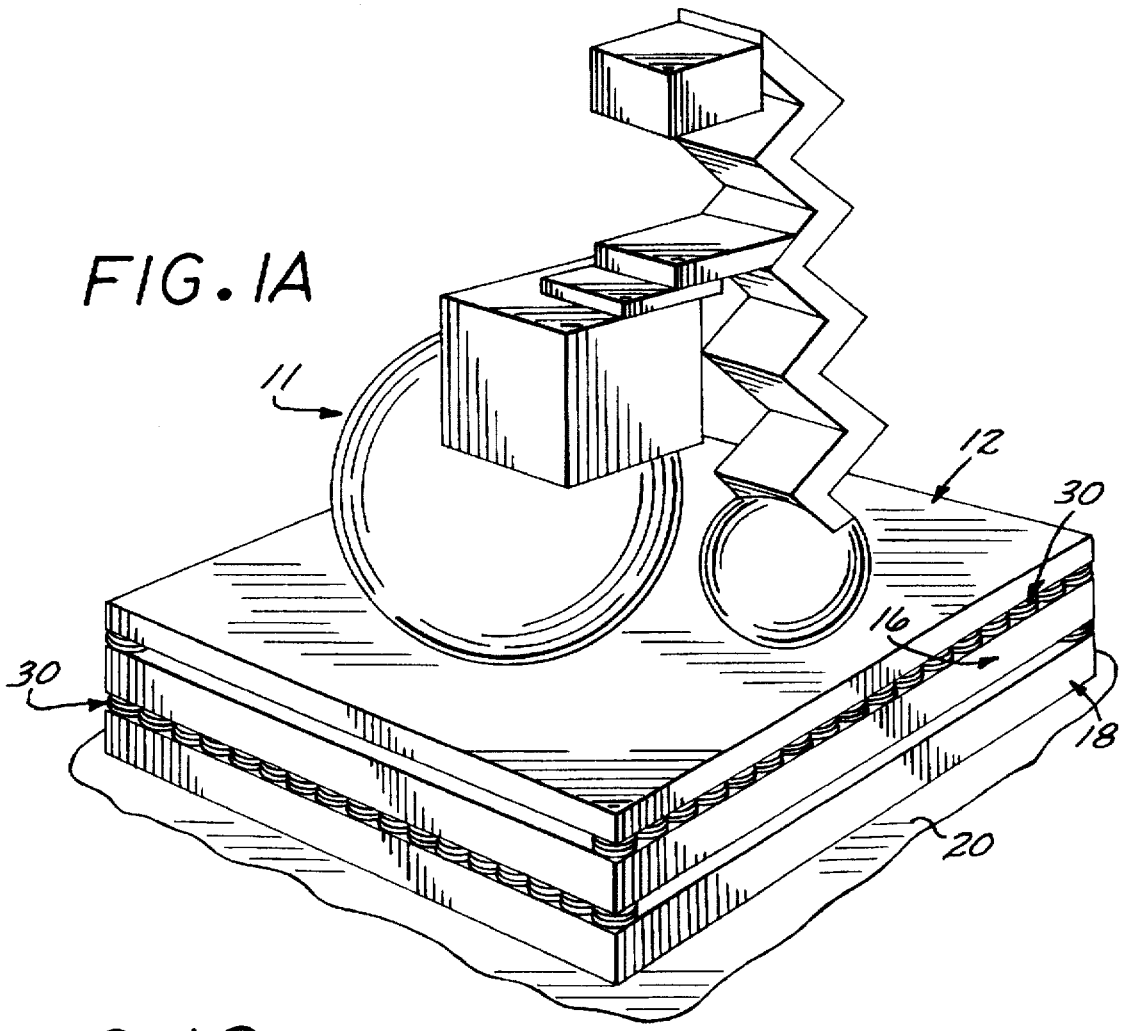
FIG. 1A is a schematic perspective view similar to FIG. 1, showing an art object secured to the isolator.
Figure 3:
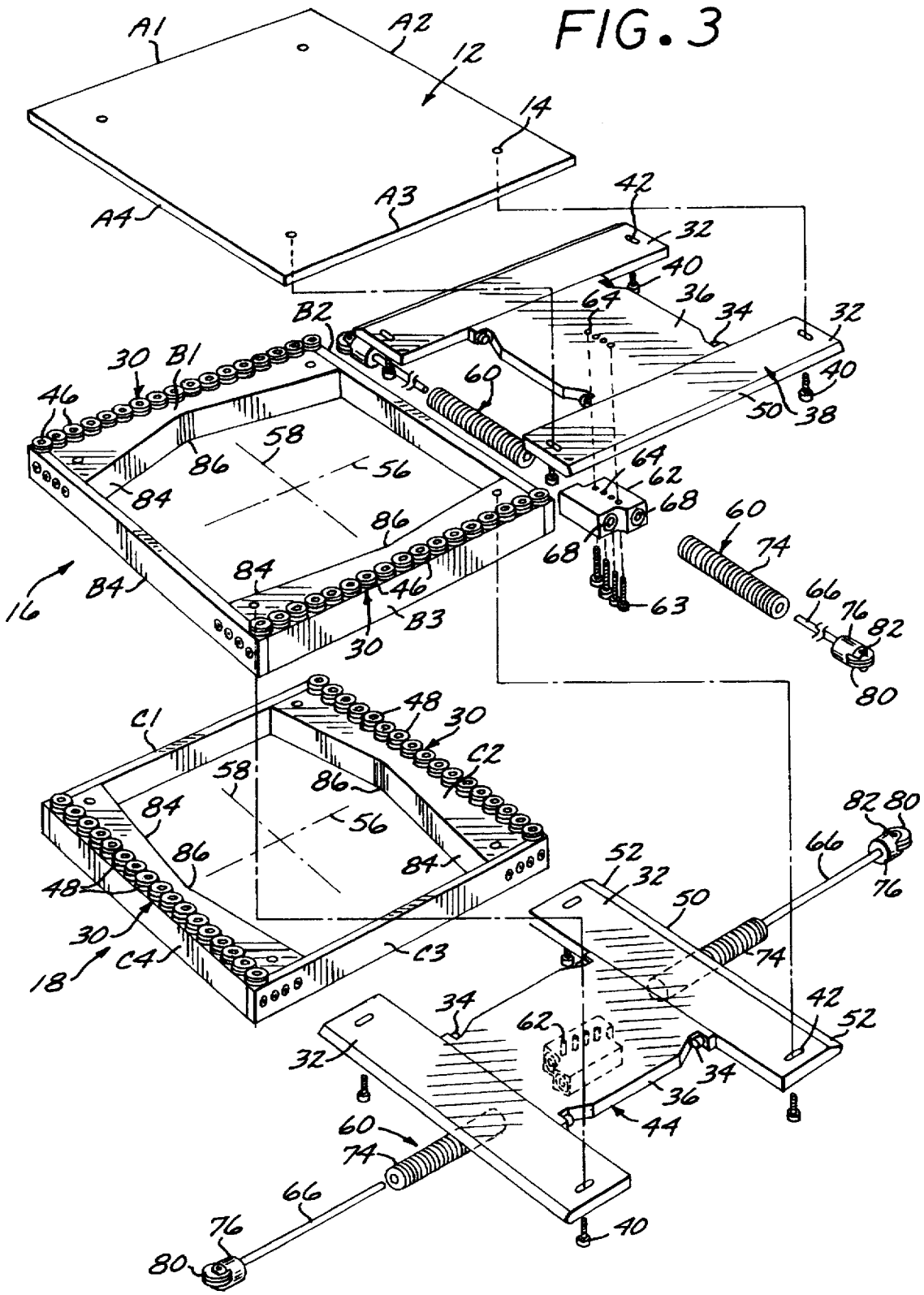
FIG. 3 is an exploded perspective view of the isolator shown in FIG. 1.
Figure 8:
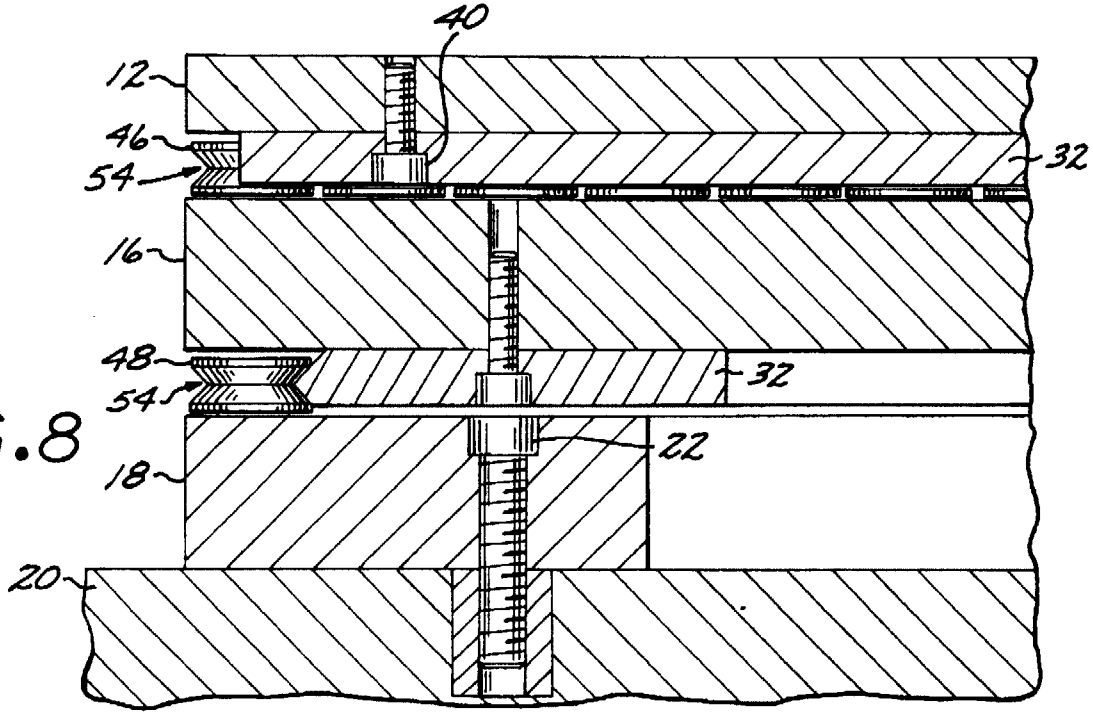
FIG. 8 is an enlarged cross-sectional view taken along line 8—8 of FIG. 4.
Figure 11:
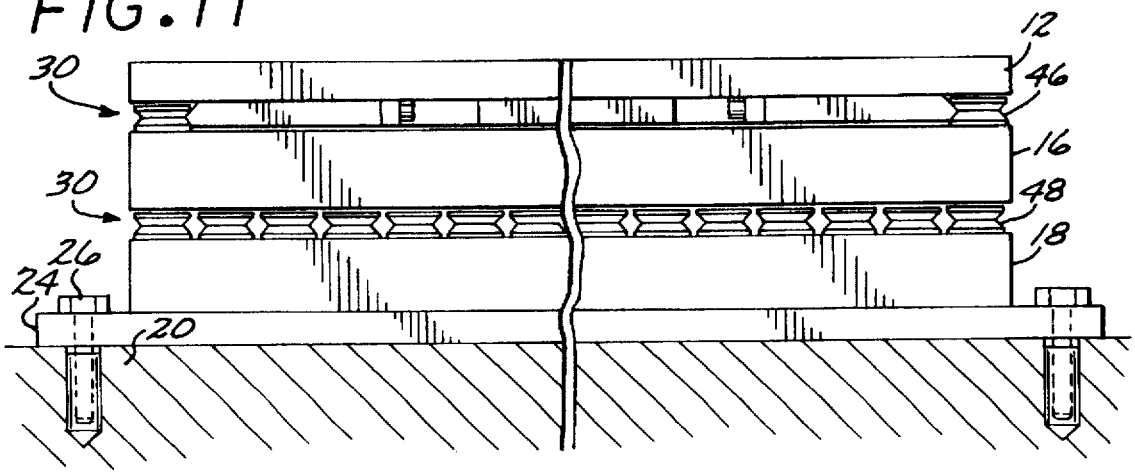
FIG. 11 is a side elevational view similar to FIG. 2, with the isolator secured to the ground via an intermediate mounting frame.

The illustrative isolator has three supports, preferably formed of rectangular plates or frames composed of hard plastic or other firm material with appropriate thicknesses and dimensions, to support the display object (see FIGS. 1, 2 and 3). As shown in FIG. 3, a top or outer support 12 is provided with a plurality of threaded holes 14 to accept an identical number of screws for securing the display object to the isolator. An intermediate support 16 is positioned between the top support 12 and a base support 18, with the latter secured in a fixed position, directly or indirectly, to the ground 20. The direct method of securing the base support 18 to the ground is shown in FIGS. 2 and 8, wherein four anchor bolts 22 are placed into the ground 20 to secure the four corners of the base support. Alternatively, as shown in FIG. 11, a mounting frame 24 may be secured to the ground by four anchor bolts 26, and the base support 18 may then be anchored to the mounting frame 24.

The intermediate support 16 is interengaged separately with the top support 12 and the base support 18 by way of two separate H-shaped assemblies 38 and 44, each of which is slidably mounted between two rows 30 of roller bearings. Each H-shaped assembly is made up of two guide bars 32, preferably rectangular, joined by four screws 34 to a cross-piece 36 in the center, thus forming the generally H-shaped assembly. The first H-shaped assembly 38 is secured to the lower side of the top support 12 by four screws 40 inserted through two sets of holes 42 in the guide bars 32. The second H-shaped assembly 44 is secured to the lower side of the intermediate support 16 in a similar fashion, except that it is rotated 90° with respect to the first H-shaped assembly 38. For ease of identification and reference, the four sides of the top support 12 are numbered A1, A2, A3 and A4; the four sides of the intermediate support 16 are numbered B1, B2, B3 and B4; and the four sides of the base support 18 are numbered C1, C2, C3 and C4 in FIG. 3. Accordingly, the guide bars of the first H-shaped assembly are mounted parallel to the A1 and A3 sides of the top support, and the guide bars of the second H-shaped assembly are mounted parallel to the B2 and B4 sides of the intermediate support.

Two parallel first rows 30 of roller bearings 46 are rotatably mounted on axles formed by screws 47 and washers 45 on the upper side of the intermediate support 16 along its B1 and B3 sides, and two parallel second rows 30 of roller bearings 48 are mounted by screws 47 and washers 45 on the upper side of the base support 18 along its C2 and C4 sides. Thus, the two second rows of roller bearings 48 are arranged such that they are normal to the two first rows of roller bearings 46 with the rollers of each of the rows mounted to rotate about parallel axes and with annular peripheral surfaces of the rollers positioned to engage the guide bars.

Figure 5:
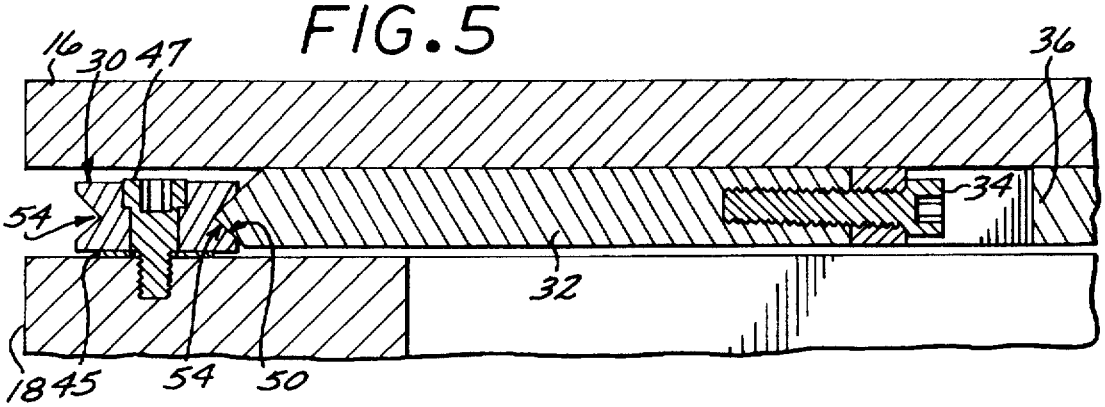
FIG. 5 is an enlarged cross-sectional view taken along line 5—5 of FIG: 4.

The exterior edge 50 of each guide bar 32 of the first and second H-shaped assemblies forms a track for the adjacent roller bearings. Preferably, each of these edges is V-shaped in transverse cross-section, with both distal ends 52 of each guide bar being slightly curved outward to form a relief. The V-shaped edge 50 of each guide bar is shaped to mate within a V-shaped groove 54 formed in each roller bearing (see FIGS. 5 and 8). Accordingly, with the first rows of roller bearings 46 along the B1 and B3 sides of the intermediate support, the two parallel tracks on the guide bars 32 of the first H-shaped assembly 38 allow the roller bearings to roll back and forth along the tracks in a horizontal plane along an X axis 56. Similarly, the guide bars 32 of the second H-shaped assembly 44 tracks for the second row of roller bearings for movement in a horizontal plane along a Y axis 58, which is normal to the X axis. The outwardly angled or relieved ends 52 of the guide bars 32 allow each guide bar to smoothly disengage and re-engage the in grooves of the roller bearings during the side-to-side movements. The preferred roller bearings 46 and 48 are Dual Vee Wheels, available through the Bishop Wisecarver Corporation, located at 2104 Martin Way, P.O. Box 1109, Pitts., Calif. 94565.

The base support of the isolator of the invention typically is fixed with respect to the ground and cannot move, so the first H-shaped assembly and the top support will move laterally along the X axis when seismic activity or other shock or vibration occurs. Simultaneously, the second H-shaped assembly and the intermediate support may move laterally along the Y axis. The direction of movement of the two supports, respectively along the X and Y axes, takes place so as to absorb the seismic movement and allow the top support 12 and the display object to move more slowly and smoothly in a resultant direction.

In the event of rapid back-and-forth movement of the ground, the base support 18 is movable back and forth without any significant effect on the intermediate and upper supports 16 and 12, except such minor motion as may be transmitted through the tracks and the roller bearings from the base support. This, of course, is substantially reduced compared to the primary seismic motion. To return the supports eventually to their initial relationship, and to cushion and smooth out the relative motions of the supports, each pair of adjacent supports (12, 16 and 16, 18) is yieldably held in its initial, rest position by at least one, and herein two, improved spring-loaded cam follower assemblies, carried on one support of each pair, that cooperate with associated cam tracks, carried on the adjacent supports of the respective pairs, to yieldably resist relative displacement of the supports along their respective axes, and then to urge the supports back to their original positions. The present invention utilizes simple and highly effective and durable cam follower assemblies in the form of elongated compression spring assemblies, preferably in the form of stacked Belleville washers, acting between the one support which carries the cam follower and the other support carrying the cam track, and shapes the cam track to load the spring smoothly and progressively during displacement of the supports.

Figure 6:
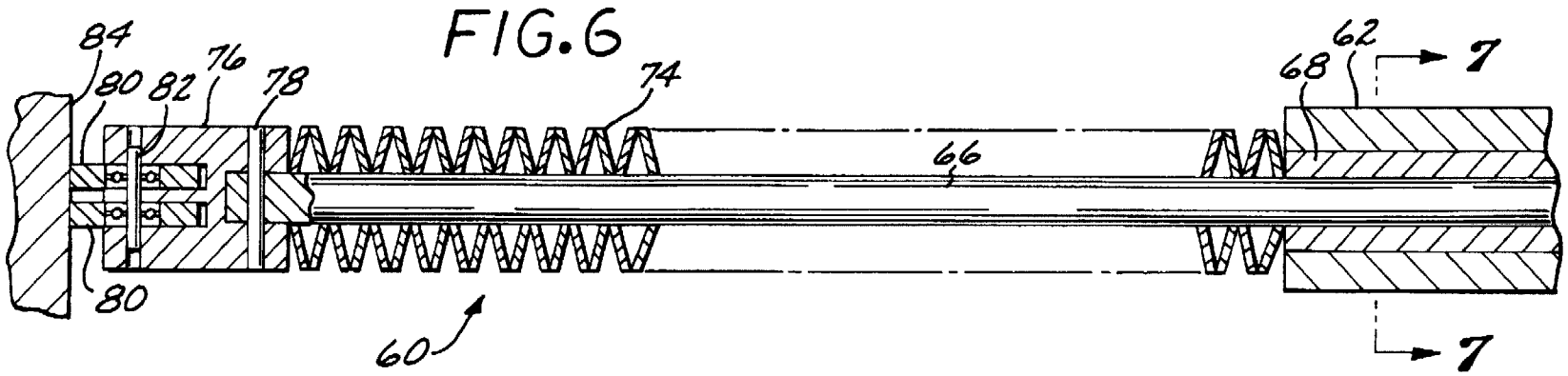
FIG. 6 is an enlarged cross-sectional view taken along line 6—6 of FIG. 4.
Figure 7:
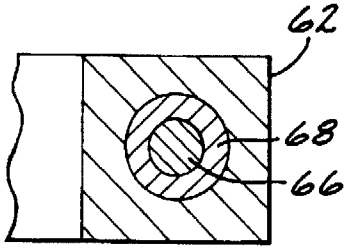
FIG. 7 is an enlarged cross-sectional view taken along line 7—7 of FIG. 6.

As illustrated in FIGS. 3, 4, 6 and 9, a compression spring assembly 60 is secured to each H-shaped assembly via a block 62 that is centered on the lower side of the crosspiece of the assembly by four screws 63 threaded through four threaded holes 64 formed in the block 62 and in the crosspiece of the H-shaped assembly. The block houses a pair of bronze-type bearings 68, and each bearing slidably receives an elongated rod 66 (see FIGS. 3, 6 and 7) which projects out of the block, transversely of the axis of movement of that support, and carries a follower at its outer end. Each rod associated with the first H-shaped assembly is offset an equal distance D from the longitudinal centerline 70 of the block (see FIG. 9), and each rod associated with the block attached to the second H-shaped assembly is also offset an equal distance D from the longitudinal centerline of the block (the longitudinal centerline of block in the latter case is normal to the longitudinal centerline of the block in the former case). A compression spring 74 is carried on each rod 66 between the block and the cam follower, which herein includes two individual roller housings 76 attached to one end of the rod by a pin 78. As shown in FIG. 6, a plurality of stacked disc springs of the Belleville type are used for this purpose, but other compression springs capable of providing a sufficient biasing force may also be used. A pair of roller followers 80 are rotatably mounted in each roller housing 76 on a pin 82 and ball bearings on the pin (see FIG. 6). Suitable roller followers and supporting bearings are of the type commonly known as number 629.

As shown in FIG. 3, the rods and the springs attached to the first H-shaped assembly are aligned perpendicularly to the direction of movement of the guide bars of the first H-shaped assembly. Also, the rods and the springs attached to the second H-shaped assembly are aligned perpendicularly to the direction of travel of the guide bars of the second H-shaped assembly. Due to the biasing force of the springs, the roller followers 80 at the end of each rod 66 follow and maintain contact with cam tracks 84 formed in the interior portions of the intermediate and base supports. Specifically, the intermediate support 16 includes two cam tracks 84 generally formed along the B1 and B3 sides, and the base support 18 includes two cam tracks 84 generally formed along the C2 and C4 sides. Each of the cam tracks has two wedge-shaped rise portions inclined inwardly toward the opposite side such that they form an obtuse (less than 180°) angle with each apex 86 off-centered in two opposite directions. The apex 86 of each cam track 84 is smoothly curved to allow continuous contact with the roller followers 80 and smooth rolling of the follower roller away from the rest or neutral position formed by the apex.

More specifically, with respect to the intermediate support, the apex 86 of the cam track along the B1 side is offset toward the B4 side, and the apex of the cam track along the B3 side is offset toward the B2 side. As to the base support, the apex of the cam track along the C2 side is offset toward the Cl side, and the apex 86 of the cam track along the C4 side is offset toward the C3 side. The offset distance of each apex is the same as the offset distance of the two rods and springs associated with the first and second H-shaped assemblies. Thus, the roller followers 80 on both sides of the blocks associated with the each H-shaped assembly are simultaneously positioned at the apexes of the two pairs of guide surfaces. In this condition, the top support 12 and the intermediate support assume their centered, neutral positions as shown in FIG. 1.

As the top support and the first H-shaped assembly move away from their centered, neutral positions toward one side along the X axis (e.g., toward side B2), the follower rollers move along the cam tracks towards side B2, thereby compressing and loading the springs on opposite sides of the blocks associated with the first H-shaped assembly between the block and the housings. The rods slide inside the bronze-type bearings housed within the block to accommodate this movement of the follower rollers. Since the block is secured to the top support, and the springs are abutted against the block in opposite directions, the springs can only expand in the direction of the roller followers 80 and the roller housings 76. This urges the roller followers along the cam tracks back toward the apex of each of the cam tracks formed along the B1 and B3 sides of the intermediate support. The initial movement and the restoration of the intermediate support relative to the base support takes place in a similar manner, except that the intermediate support moves along the axis that is perpendicular to the axis along which the top support slides. If the severity of the external shock or vibration should cause the follower rollers to go past the apex of each of the cam tracks, the compression of the springs against the opposite side of the cam track will return the followers back to the apex. After one or more side-to-side movements, the top support and the intermediate support are restored to their centered, neutral positions where the followers rest against the apexes of the cam tracks.

Figure 10:
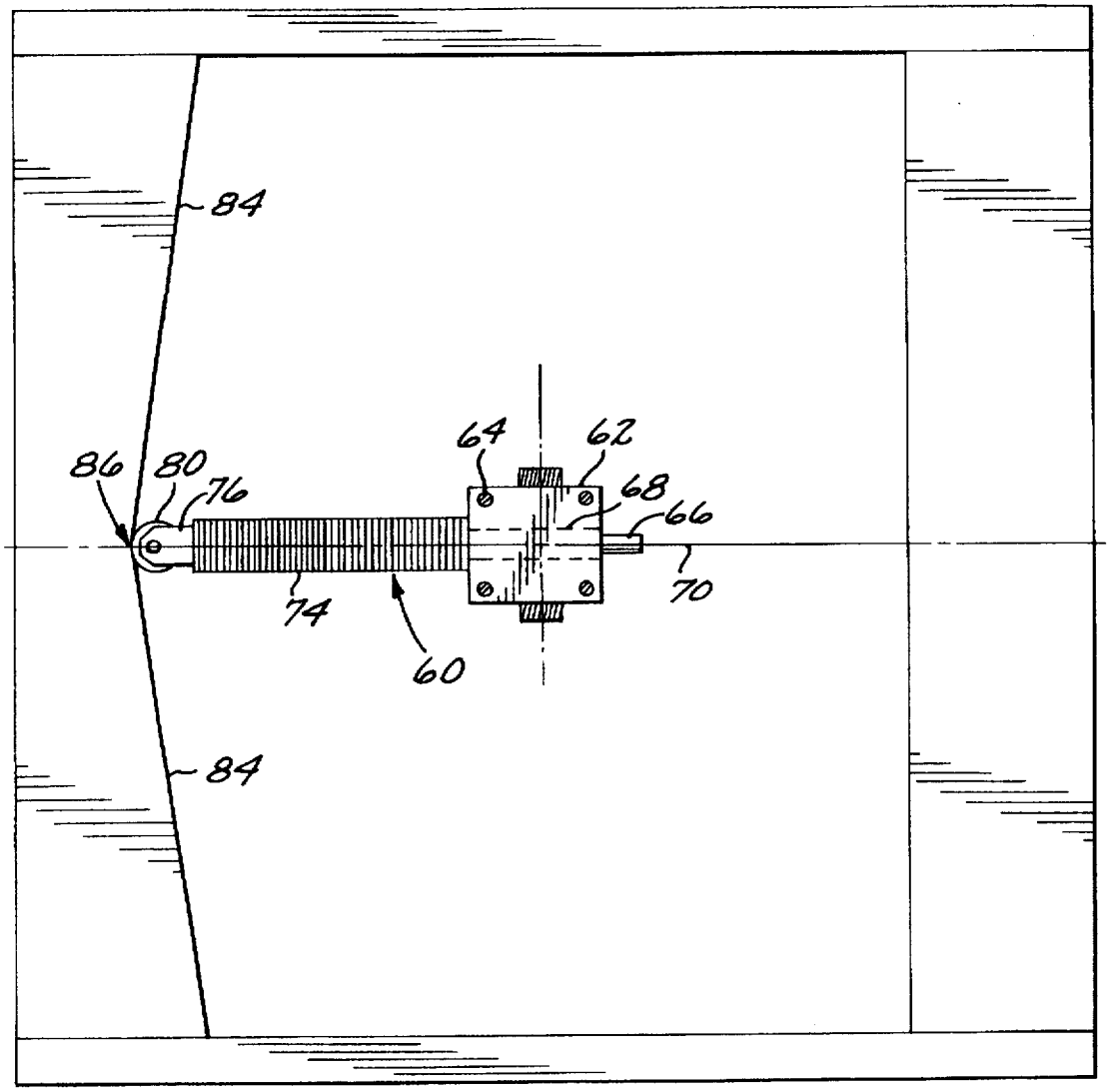
FIG. 10 is a bottom plan view of an alternative embodiment of the spring and roller assembly shown in FIG. 9.

In an alternative embodiment of the invention shown in FIG. 10, a single rod and spring combination is used for each H-shaped assembly. This is suitable for supporting relatively lightweight objects (typically less than 1,500 pounds) on the isolator.

Figure 4:
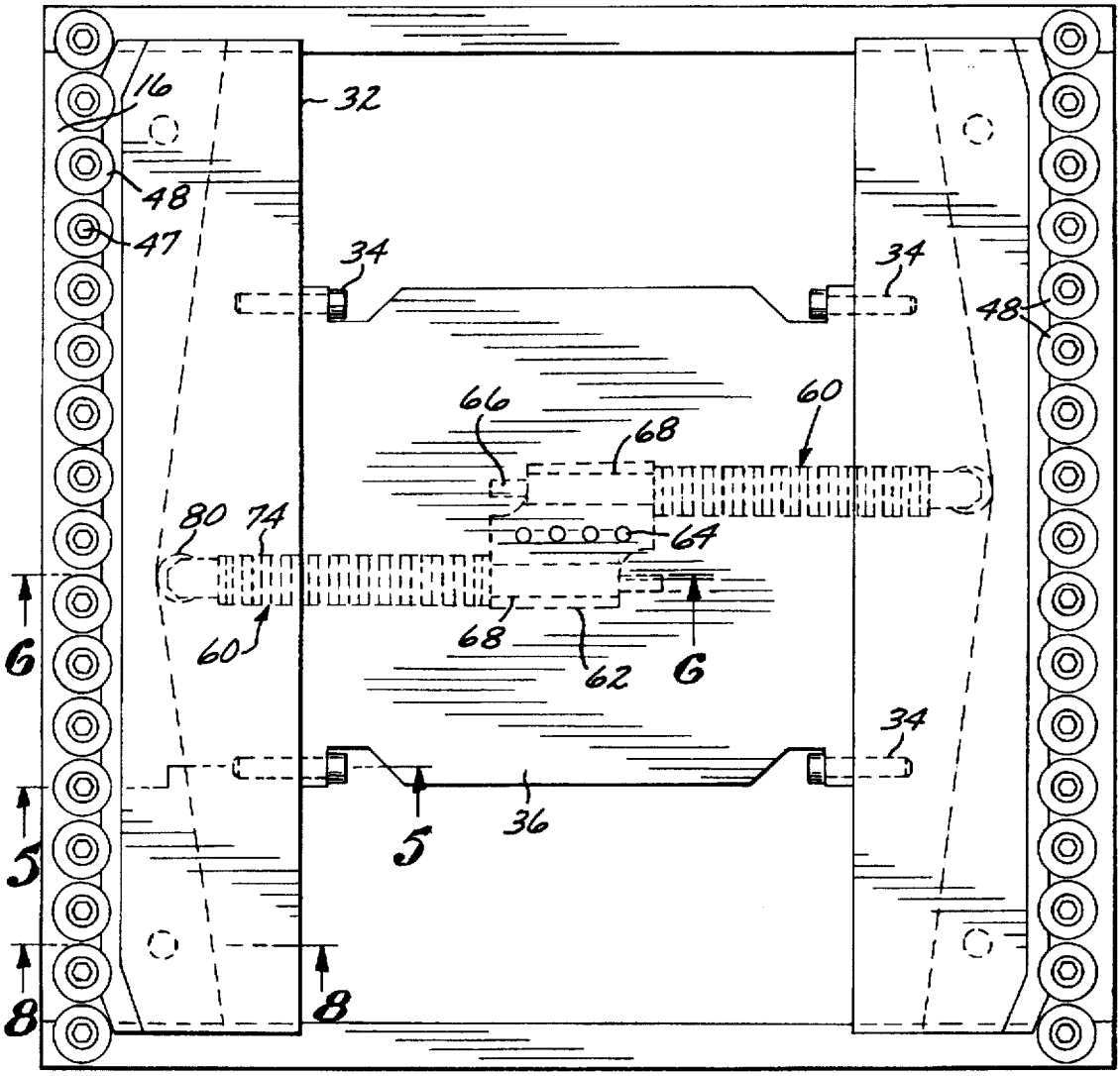
FIG. 4 is an enlarged sectional view, taken along line 4—4 of FIG. 2, with some of the components shown in broken lines to illustrate the operation of the isolator of the invention.
Figure 9:
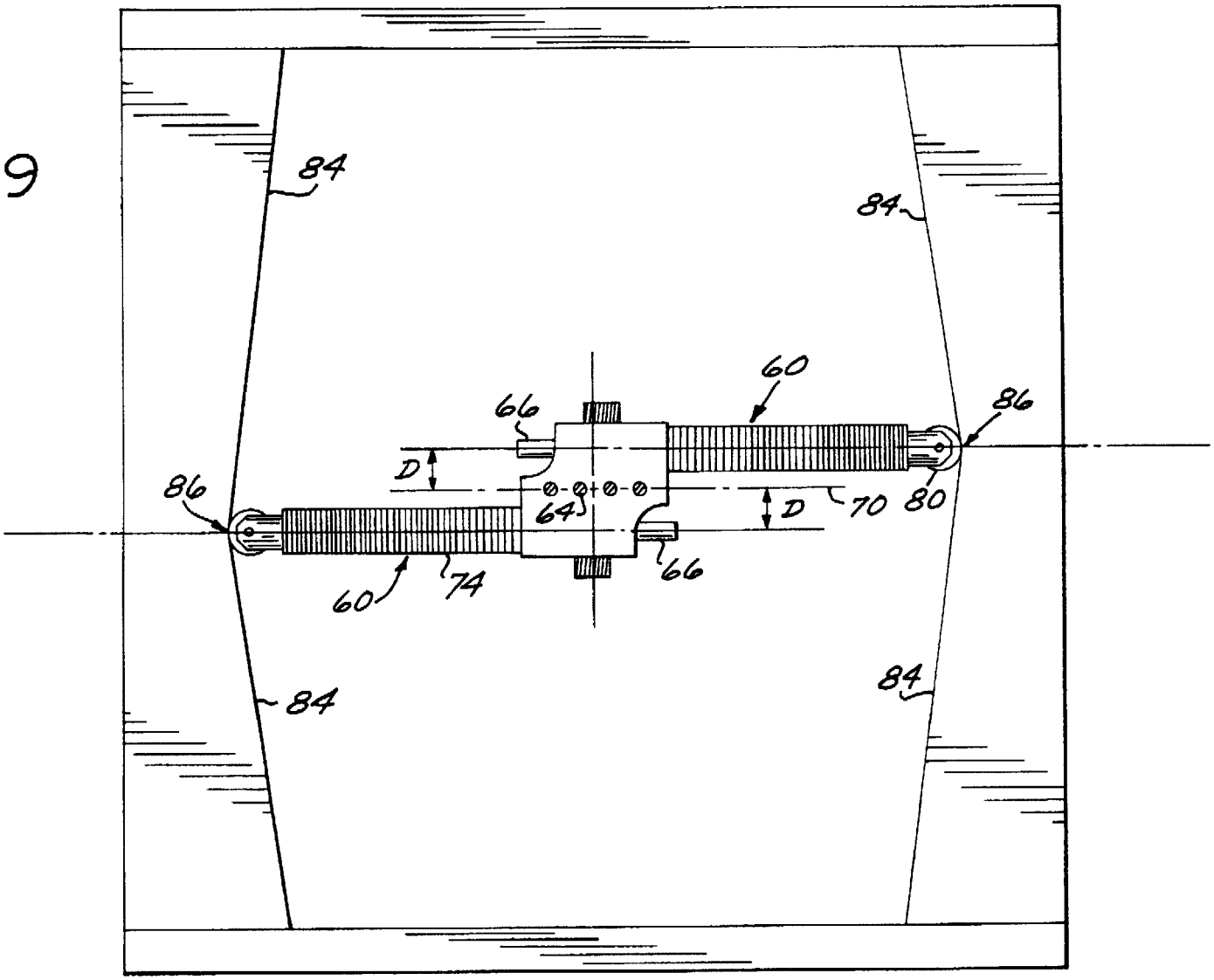
FIG. 9 is a bottom plan view of a portion of a spring and roller assembly used to restore the levels of the isolator shown in FIG. 1 to its centered position.

The alternative embodiment shown in FIG. 10 is the same as the embodiment shown in FIGS. 3, 4 and 9, with a few exceptions. Specifically, in this alternative embodiment, using previously used numbers to refer to similar components, each H-shaped assembly is secured to a block 62 that houses a single bronze-type bearing 68 and a single rod 66 slidably positioned inside the bearing 68. One end of each rod is secured to a roller housing 76 by a pinned connection. Each roller housing preferably carries at least one, and preferably two, roller followers 80 at its far end, and a compression spring 74 is telescoped over each rod and located between the block and the roller housing attached to each rod, (with no offset from the centerline of each block). Thus, the single spring biases the roller followers against the cam track 84 formed along one side of the support, and exerts the yieldable force to cushion the movement and restore the support to its initial position.

Figure 12:
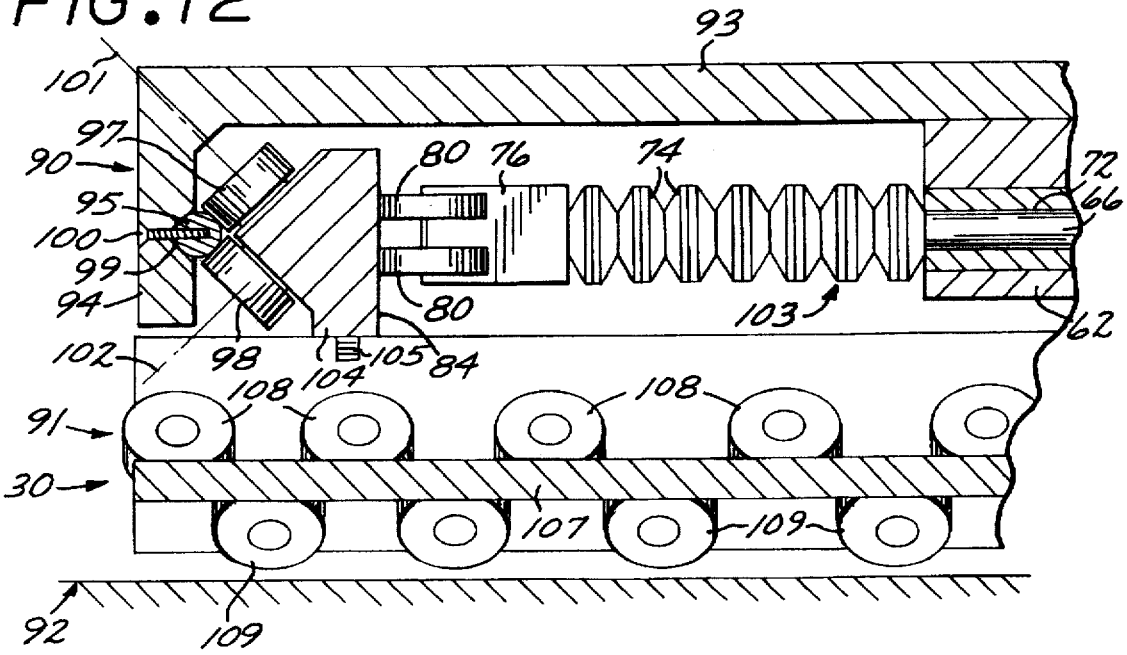
FIG. 12 is an enlarged cross-sectional view showing an alternative embodiment of the isolator.

In another alternative embodiment of the invention, shown in FIG. 12, a modified roller bearing arrangement is provided for the interengagement and relative movement of adjacent supports 90 and 91, and a third support 92 which may be a third relatively movable support. In this alternative embodiment, the upper or outer support 90 comprises an upper plate 93 having depending skirts 94 on opposite sides, only one side being shown in the drawing, and carrying a track 95 on each skirt for engagement with double rows of roller bearings 97 and 98 that are mounted on the adjacent lower support 91. Only one set of such roller bearings is shown, in rolling engagement with the track 95, but it is to be understood that a similar skirt, track and set of roller bearings 97 and 98 is provided along the opposite sides of the supports 90 and 91.

Specifically, the track 95 in this instance is an elongated rod or bar of circular cross-sectional shape that is fitted into a V-shaped mounting groove 99 in the inner sidewall of the skirt 94 and fastened in place, herein by screws as shown at 100 in FIG. 12. Approximately one-half of the thickness of the track bar 95 protrudes from the groove 100 for engagement with the roller bearings 97 and 98, which in this embodiment are mounted for rotation about axes 101 and 102 that are angularly spaced ninety degrees apart. Thus, the peripheral surfaces of the roller bearings, which are ungrooved, engage the track bar ninety degrees apart, forming, in effect, a V-groove between the two rows of roller bearings. Each row preferably comprises a plurality of bearings, as can be seen generally on the lower support 91 in FIG. 12.

In a manner similar to that of the first embodiment, the upper support 90 of the adjacent supports 90, 91 carries a spring-loaded cam follower assembly 103 similar to the corresponding assembly 60 of the first embodiment, with similar parts identified by the same reference numbers. The follower rollers 80 of this embodiment engage a cam track 84 that is formed on one side of a bar 104 bolted at 105 to the lower support 91, with the roller bearings 97 and 98 mounted on two angularly disposed faces 108 and 108 of this bar, opposite the cam track. As in the preferred embodiment, the follower rollers are carried on a housing 76 on a rod 66 that slides in a sleeve bearing 72, and this bearing is mounted on the underside of the plate 93 of the upper support 90.

Because the bar 104 supporting the roller bearings 97 and 98 is secured to the lower support 91, relative movement of the upper support 90 loads the springs 74 and will be cushioned by those springs, which then will urge the upper support back toward its normal position relative to the lower support. For this purpose, the cam track 84 has the same configuration as the cam tracks 84 in the first embodiment.

Also shown in part in FIG. 12 is the structure that supports the support 91 on the lower support 92 for back-and-forth relative movement along a transverse axis, normal to the axis of movement of the support 90. A track rod or bar 107, similar to the bar 95, is shown in cross-section in engagement with a double row of roller bearings 108 and 109, these being similar to the roller bearings 97 and 98 but normal thereto. The bar 107 is attached to a skirt (not shown) on the support 91, and the rollers 108 and 109 are supported on a bar (not shown) similar to the bar 104 formed with a cam track like the track 84, but generally normal thereto, and engaged by one or more spring-loaded cam follower assemblies on the support 91, like the assembly on the support 90. As a result, the supports 90 and 91 can move relative to the base support 92, as in the first embodiment, but along simplified track bars 95 and 107 on double rows of roller bearings. This arrangement of bearings is advantageous with respect to load distribution.

From the foregoing, it will be appreciated that the isolator of the invention provides an improved device of the general type disclosed in U.S. Pat. No. 5,035,394 for protecting objects from seismic and other shock or vibration that is less complicated, less expensive, highly efficient and effective, and strong, yet relatively lightweight. The isolator of the invention can be assembled in a relatively short time, and with relative ease, can be modified to accommodate objects with varying sizes and weights.

While particular forms of the invention have been illustrated and described, it will be apparent that various modifications can be made to the present invention without departing from the spirit and scope thereof.

I claim as my invention:

1. A seismic isolator for protecting a supported object from shocks such as earthquake shock, comprising:

three relatively movable, vertically stacked supports normally disposed in vertically aligned positions and including a top support in the form of a flat, thin plate having two laterally spaced side edges and an underside, an intermediate support in the form of a relatively thin and flat frame disposed beneath said top support and having two laterally spaced side edges normal to said side edges of the top support and an underside and a top side, and a base support disposed beneath said intermediate support and having two laterally spaded side edges normal to the side edges of the intermediate support and a top side;

a first pair of guide bars mounted on the underside of the top support and having oppositely facing and parallel surfaces extending generally along said side edges of the top support in laterally spaced relation therewith to form parallel first tracks;

a second pair of guide bars mounted on the underside of said intermediate support and having oppositely facing and parallel surfaces extending generally along said edges of the intermediate support in laterally spaced relation therewith to form parallel second tracks;

two rows of first roller bearings straddling said first tracks and rotatably mounted on top side of said intermediate support beneath said side edges of said top support with the rollers of each of said rows mounted to rotate about parallel axes and with annular peripheral surfaces of the rollers in close rolling engagement with said first tracks thereby to mount said top support on said intermediate support for relative back and forth movement along a first displacement axis parallel to said first tracks;

two rows of second roller bearings straddling said second tracks and rotatably mounted on said top side of said base support beneath said side edges of said intermediate support with the rollers of each of said rows mounted to rotate about parallel axes and with annular peripheral surfaces of the rollers in close rolling engagement with said second tracks thereby to mount said intermediate support on said base support for relative back and forth movement along a second displacement axis parallel to said second tracks and normal to said first tracks;

two first cam tracks formed on said intermediate support along said side edges thereof and each having a neutral portion corresponding to the normal resting position of the supported object and a wedge-shaped rise portion on each side of the neutral portion inclined inwardly toward the opposite side edge of said intermediate support;

two first substantially straight spring-loaded cam follower assemblies carried by said top support on the underside thereof and each comprising a roller follower engaging a cam track, an elongated, non-flexible compression spring assembly having an inner end and an outer end for supporting said roller follower on its outer end for engagement with the cam track and pressing said follower against the track, and means supporting the inner end of each compression spring assembly on the underside of the top support for movement of the cam follower assemblies with the top support relative to the intermediate support; and two second cam tracks similar to said first cam tracks formed on said base support along said side edges thereof and two second spring-loaded cam follower assemblies similar to said first spring-loaded cam follower assemblies carried by said intermediate support on the underside thereof for movement with the intermediate support relative to the base support;

whereby said top and intermediate supports are freely displaceable along said first and second tracks relative to each other and to the base support from vertically aligned positions, and said spring-loaded cam follower assemblies cooperate with said cam tracks to yieldably resist such displacement and to return the supports to vertically aligned positions.

2. A seismic isolator as defined in claim 1 wherein said roller bearings have V-grooved annular peripheral surfaces and said tracks are of complementary V-shaped cross-sectional shape thereby to confine said rollers on said tracks.

3. A seismic isolator as defined in claim 2 wherein each of said tracks is relieved adjacent its opposite ends to allow smooth disengagement and re-engagement of the roller bearings and the tracks at the ends.

4. A seismic isolator as defined in claim 2 wherein each row of roller bearings includes a plurality of roller bearings adjacent each end of the adjacent side edge of the support on which the roller bearings are mounted.

5. A seismic isolator as defined in claim 2 wherein each row of roller bearings comprises a series of equally spaced roller bearings extending substantially the full length of the adjacent side edge.

6. A seismic isolator as defined in claim 1 wherein each of said spring-loaded cam follower assemblies comprises a guide secured to the underside of the support for the assembly, an elongated rod slidably mounted at its laterally inner end in said guide and projecting laterally from the guide toward said neutral portion of said cam track with said roller follower rotatably mounted on its free outer end, and a relatively stiff and resiliently compressible spring telescoped over said rod between said roller follower and said guide and acting between said guide and said roller follower initially to hold the latter adjacent said cam track and to be compressed by the action of said cam track and the roller follower as the latter moves away from said neutral portion in either direction, thereafter to urge the follower, and thus the supports, back to the normal resting position.

7. A seismic isolator as defined in claim 6 further including a sleeve bearing secured and located inside said guide and telescoped over said rod to allow said rod to slide within said sleeve bearing.

8. A seismic isolator as defined in claim 6 wherein said spring comprises a plurality of oppositely cupped pairs of disc washers telescoped over said rod.

9. A seismic isolator as defined in claim 6 wherein said roller follower comprises two rollers rotatably mounted in spaced-apart, parallel fashion on an axle secured in a housing mounted on the free outer end of said rod.

10. A seismic isolator as defined in claim 6 wherein the guides for the two cam follower assemblies on each support are integrally joined together as a single block centrally secured to the support.

11. In a seismic isolator of a type having a base support, at least one intermediate support adjacent to the base support, and an outer support adjacent to the intermediate support, and having means for supporting the intermediate and outer supports to move transversely relative to each other and to the base support along angularly disposed displacement axes, and means for yieldably resisting such relative movement along said displacement axes from a normal resting position, the improvement wherein said means for yieldably resisting relative movement between each two adjacent supports comprises:

a continuous cam track formed on one of said adjacent supports to extend generally along the displacement axis for the two adjacent supports, said cam track having a neutral position corresponding to the normal resting position and inclines relative to said axis extending in bath directions from the neutral position;

a follower carried on the other of the two adjacent supports to engage said cam track in the neutral position and travel in either direction therefrom during relative movement of the adjacent supports in either direction; and means for yieldably urging said follower toward and against said cam track comprising a non-flexible compression spring assembly having one end connected to said other of the two adjacent supports and an opposite end carrying said follower;

said cam track and said compression spring assembly normally holding said follower in said neutral position end pressing the follower against said cam track to urge the follower back toward said neutral position when the two adjacent supports have been displaced.

12. The improved seismic isolator defined by claim 11 wherein said cam track has a central depression defining said neutral position, and two wedge-shaped arms extending in opposite directions from said central depression forming said inclines.

13. The improved seismic isolator defined by claim 11 wherein said compression spring assembly comprises an elongated rod carried at one end on said other of the two adjacent supports and slidable thereon between retracted and extended positions, a cam follower carried on the opposite end of said rod for engagement with said cam track, and a compression spring acting between said support and said follower to hold the follower adjacent to said cam track in the neutral position when said rod is extended, said spring being compressible as said follower moves along said cam track thereby to accommodate displacement while loading of the compression spring to resist such movement and urge the supports toward the normal position.

14. The improved seismic isolator defined by claim 13 wherein said cam follower is at least one roller rotatably mounted on said rod.

15. The improved seismic isolator defined by claim 13 wherein said compression spring is a stack of cupped spring washers arranged in opposed pairs on said rod and acting between said support and said cam follower.

16. The improved seismic isolator defined by claim 13 wherein the first-mentioned cam track is formed along one side of said one of the two adjacent supports, and a second similar cam track is formed on that support along an opposite side thereof to extend along the displacement axis in spaced relation with said first-mentioned cam track; and a second follower and a second means for yieldably urging the second follower toward and against the second cam track and comprising a similar non-flexible compression spring assembly are provided for engagement with the second cam track thereby to substantially double and balance the force for holding said two adjacent supports in and returning them to the normal position.

17. In a seismic isolator of the type having a base support, at least one intermediate support and an outer support and having mounting means for supporting the intermediate and outer supports to move transversely relative to each other and to the base support along angularly disposed displacement axes, and having means for yieldably resisting such relative movement along said displacement axes, the improvement wherein said mounting means between two adjacent supports comprise:

two laterally spaced rows of roller bearings parallel to the displacement axis for said adjacent supports, the roller bearings of each row being rotatably supported on one of the adjacent supports to rotate about parallel axes;

two oppositely facing tracks, each track being carried by one of the adjacent supports in position for rolling engagement with one series of roller bearings, and said tracks being disposed in opposing relation with said roller bearings thereby to prevent movement of the adjacent supports transversely of the displacement axes; and wherein said roller bearings have V-grooved faces and said track is complementarily V-shaped in cross-sectional shape and sized to fit closely in said V-grooved faces whereby said mounting means hold said adjacent supports against displacement in any direction except along the displacement axis for those supports.

18. The improved seismic isolator defined by claim 17 wherein said roller bearings have V-grooved faces and said track is complementarily V-shaped in cross-sectional shape and sized to fit closely in said V-grooved faces whereby said mounting means holds said adjacent supports against displacement in any direction except along the displacement axis for those supports.

19. The improved seismic isolator defined by claim 17 wherein the means for yieldably resisting the relative movement of the adjacent supports along the displacement axes for the supports comprise:

a cam track formed on one of said supports to extend generally along the displacement axis, said cam track having a neutral position corresponding to the normal resting position of the object to be supported, and an effective incline relative to said axis in both directions from the neutral position;

a follower positioned on the other of said supports to engage said cam track in said neutral position and travel in either direction therefrom during relative movement of the adjacent supports in either direction; and means for urging said follower yieldably toward and against said cam track comprising an elongated compression spring assembly having one end connected to said other support, another end carrying said follower, and means yieldably urging said follower toward the cam track;

said cam track and said compression spring assembly normally holding said follower in said neutral position and urging said follower back toward said neutral position when the adjacent supports have been displaced; and wherein said compression spring assembly comprises an elongated rod slidably mounted at one end on said other support and extending toward said cam track, a follower carried on said rod for engagement with said cam track, and an elongated compression spring mounted over said rod and acting between said support and said follower and normally holding said follower in engagement with said cam track in the neutral position when said rod is extended, said compression spring being compressible as said follower moves along said cam track thereby to accommodate the lateral displacement while increasing the loading of the compression spring.

20. The improved seismic isolator defined by claim 19 wherein said follower is at least one roller rotatably mounted on said rod.

21. The improved seismic isolator defined by claim 20 wherein each of said rows is a double row of roller bearings arranged for rotation about axes that are angularly spaced apart to impose the peripheral surfaces of the roller bearings of each double row at an angle, thereby to form, in effect, a V-shaped roller groove for engagement with the track.

22. The improved seismic isolator defined by claim 20 wherein each track is an elongated bar having angularly spaced portions for engagement with the roller bearings.

23. The improved seismic isolator defined by claim 20 wherein said compression spring is a stack of Belleville disc washers arranged in opposed pairs on said rod.

24. The improved seismic isolator defined by claim 19 wherein the first-mentioned cam track is formed along one side of said one support, and a second similar cam track is formed on said one support along an opposite side of said one support to extend along the displacement axis in spaced relation with said first-mentioned cam track; and a second follower and a second compression spring assembly urging the second follower toward and against the second cam track are provided for engagement with the second cam track thereby to substantially double and balance the force for holding said adjacent supports in, and returning them to, the normal position.

25. The improved seismic isolator defined by claim 24 wherein said spring assemblies and followers are offset in opposite directions from the center of said supports.

26. In a seismic isolator of the type having a base support, at least one intermediate support and an outer support and having mounting means for supporting the intermediate and outer supports to move transversely relative to each other and to the base support along angularly disposed displacement axes, and having means for yieldably resisting such relative movement along said displacement axes, the improvement wherein said mounting means between two adjacent supports comprise:

two laterally spaced rows of roller bearings parallel to the displacement axis for said adjacent supports, the roller bearings of each row being rotatably supported on one of the adjacent supports to rotate about parallel axes;

two oppositely facing tracks, each track being carried by one of the adjacent supports in position for rolling engagement with one series of roller bearings, and said tracks being disposed in opposing relation with said roller bearings thereby to prevent movement of the adjacent supports transversely of the displacement axes; wherein said roller bearings have V-grooved faces and said track is complementarily V-shaped in cross-sectional shape and sized to fit closely in said V-grooved faces whereby said mounting means hold said adjacent support against displacement in any direction except along the displacement axis for those supports; and wherein each of said laterally spaced rows of roller bearings comprises a double row of such bearings arranged for rotation about axes spaced ninety degrees apart with the peripheral surfaces of the roller bearings of each double row forming, in effect, a V-shaped roller groove for engagement with the track.

27. The improved seismic isolator defined in claim 26 wherein each of said double rows of roller bearings is mounted on a bar on said one support, said bar having mounting surfaces disposed at a ninety degree angle with each other.

28. The improved seismic isolator defined in claim 26 wherein said tracks are elongated bars positioned on the other of said supports in alignment with said rollers, with said double rows of roller bearings engaging angularly spaced areas of said bars.

29. The improved seismic isolator defined in claim 26 wherein said bars are cylindrical rods.

30. The improved seismic isolator defined in claim 26 wherein said double rows of roller bearings on said one support are mounted alongside a skirt depending from the other support, and said tracks are elongated rods secured to said depending skirts.

31. In a seismic isolator of the type having a base support, at least one intermediate support adjacent to the base support, and an outer support adjacent to the intermediate support and having mounting means for supporting the intermediate and outer supports to move transversely relative to each other and to the base support along angularly disposed displacement axes, and having means for yieldably resisting such relative movement along said displacement axes, the improvement wherein said mounting means between two adjacent supports comprise:

two pairs of laterally spaced rows of roller bearings parallel to the displacement axis for the two adjacent supports, the roller bearings of each pair of rows being rotatably supported on one of the two adjacent supports to rotate about angularly disposed axes; and two oppositely facing tracks, each track being carried by one of the two adjacent supports in position for rolling engagement with one pair of rows of roller bearings, and said tracks being disposed in opposing relation with said roller bearings thereby to prevent movement of the two adjacent supports transversely of the displacement axes; and wherein said roller bearings have V-grooved faces and said track is V-shaped in transverse cross-sectional shape and sized to fit closely in said V-grooved faces whereby said mounting means hold said adjacent supports against displacement in any direction except along the displacement axis for those supports.

32. The improved seismic isolator defined by claim 31 wherein said two adjacent supports are said base support and said intermediate support, and a second mounting means having the same structure as the first-mentioned mounting means is provided between said intermediate support and said outer support, the pairs of rows of roller bearings and the tracks of said second mounting means being normal to the rows of roller bearings and tracks for the base and intermediate supports.

33. The improved seismic isolator defined by claim 31 wherein said pair of rows of roller bearings of each of said mounting means are laterally spaced apart and rotatably mounted on the same support, and wherein said tracks are positioned between the pair of rows of roller bearings for rolling engagement with the roller bearings on adjacent sides of the rows.

* * * * *